US006573442B1

(12) United States Patent
Lombardi

(10) Patent No.: US 6,573,442 B1
(45) Date of Patent: Jun. 3, 2003

(54) ANTI-FRICTION DRUM STRAND TENSIONER

(75) Inventor: Donald G. Lombardi, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 09/976,955

(22) Filed: Oct. 15, 2001

(51) Int. Cl.[7] ..... G10D 13/02
(52) U.S. Cl. ..... 84/415; 84/413; 84/417
(58) Field of Search ..... 84/415, 413, 417, 84/421

(56) References Cited

U.S. PATENT DOCUMENTS 5,557,053 A * 9/1996 Nickel ..... 84/415
5,616,875 A * 4/1997 Lombardi ..... 84/415

* cited by examiner

*Primary Examiner*—Kim Lockett
(74) *Attorney, Agent, or Firm*—William W. Haefliger

(57) ABSTRACT

A throw-off device for use on a drum having a side wall and a head, a support body attachable to the side wall of the drum, a tensioning member movable relative to the body to tension or release strands adjacent the drum head, a lever movable between selected positions, and cam and follower roller elements that are relatively movable in response to lever movement to effect member movement.

12 Claims, 6 Drawing Sheets

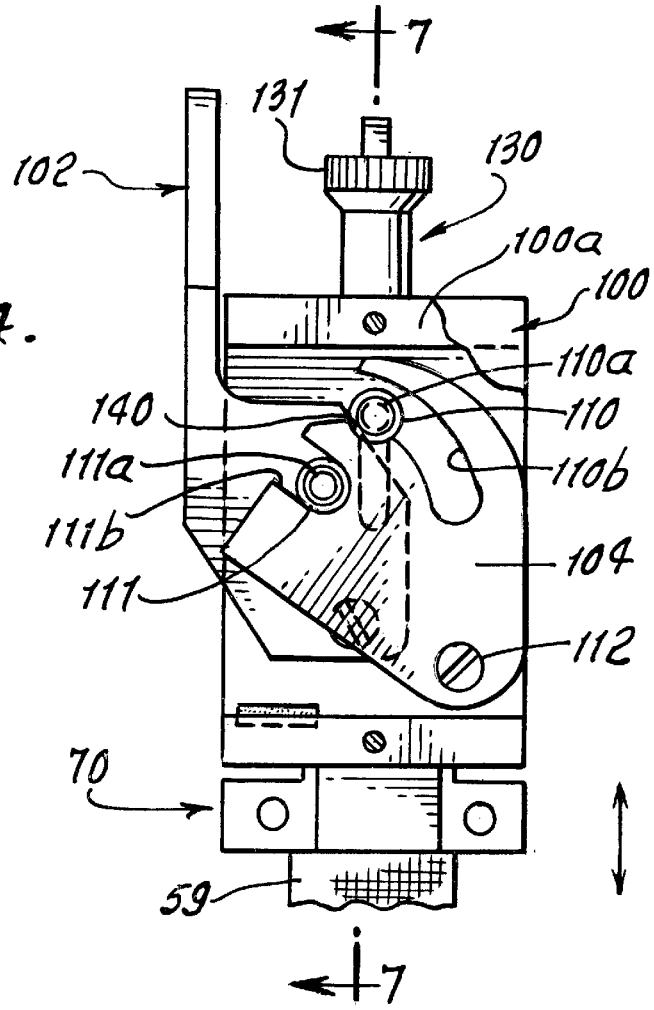
FIG. 4.
FIG. 5.
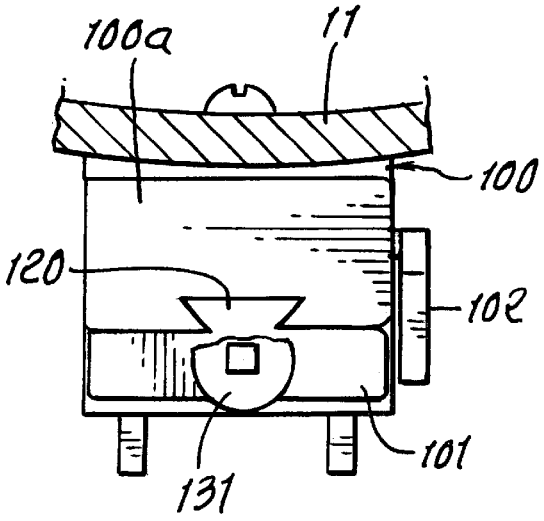
FIG. 6.
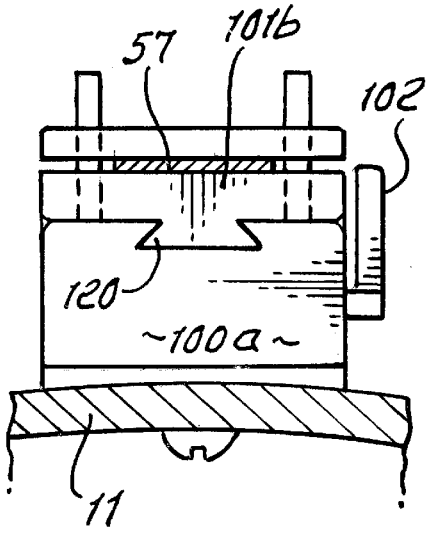

ANTI-FRICTION DRUM STRAND TENSIONER

BACKGROUND OF THE INVENTION

This invention relates generally to drumming apparatus, and more particularly to auxiliary apparatus attachable to a drum, such as a tom-tom, for tensioning and releasing multiple strands that co-act with the drum head to produce desired acoustic effects.

There is need for an improved, simple, effective throw-off device that a drummer may use to quickly tension and/or release strands, such as metal wires, that are used adjacent a drum head to produce certain distinctive acoustic effects, upon beating a drum, as for example a tom-tom drum.

More particularly, there is need for an adjustment that will easily and compactly allow adjustable tensioning of such strands, for tuning of the desired acoustic effects.

SUMMARY OF THE INVENTION

It is a major object of the invention to provide improved apparatus meeting the above needs. Basically, the improved apparatus or device of the invention comprises:

a) a support body attachable to the side wall of the drum,
b) a tensioning member movable relative to said body to tension or release strands adjacent the drum head,
c) a lever movable between selected positions,
d) and cam and follower roller elements that are relatively movable in response to said lever movement to effect said member movement.

As will be seen, the roller elements desirably take the form of roller bearings, to minimize frictional resistance to quick lever movement. One of the cam and follower roller elements is typically carried by said lever and the other of said elements is carried by said tensioning member. For compactness, the lever typically extends between said tensioning member and said cam; and the cam is located between said lever and one part of said support body attachable to said side wall of the drum; the cam also being protected between the one part and a second part of the support body. Also, the lever projects to be swingable in a plane that is parallel to said cam plate, for compactness.

It is another object to provide two roller guide slots in the cam, for accurate cam and captivated roller guiding action, during lever swinging.

A yet further object is to provide a device as referred to wherein the tensioning member has first and second sections which are relatively movable, one section connected to drum head striking strands, and adjustment means to control such relative movement of said sections to effectively tune the striking action of the strands, when tensioned by movement of the lever.

It is a further object to provide a compact device that includes:

a) first and second components which are relatively moveable,
b) drum head striking strands operatively connected to one of said components to be tensioned and de-tensioned in response to such movement,
c) and a lever having roller bearing operative connection to at least one of said components, to effect said movement thereof.

These and other objects and advantages of the invention, as well as the details of an illustrative embodiment, will be more fully understood from the following specification and drawings, in which:

DRAWING DESCRIPTION

FIG. 4 is an elevation taken on lines 4—4 of FIG. 3 showing lever structure to tension a strap and metal strands adjacent a drum head;

FIG. 5 is a top plan view of the FIG. 4 structure;

FIG. 6 is a bottom plan view of the FIG. 4 structure;

DETAILED DESCRIPTION

Figure 1:
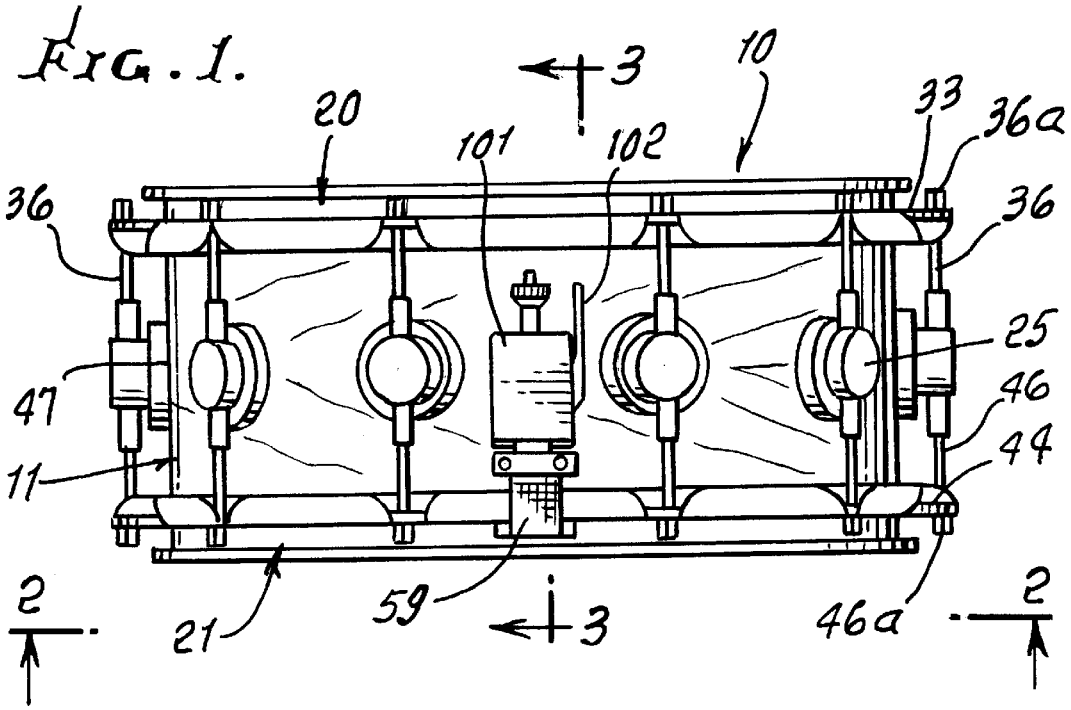
FIG. 1 is a side elevational view of a drum incorporating the invention.
Figure 2:
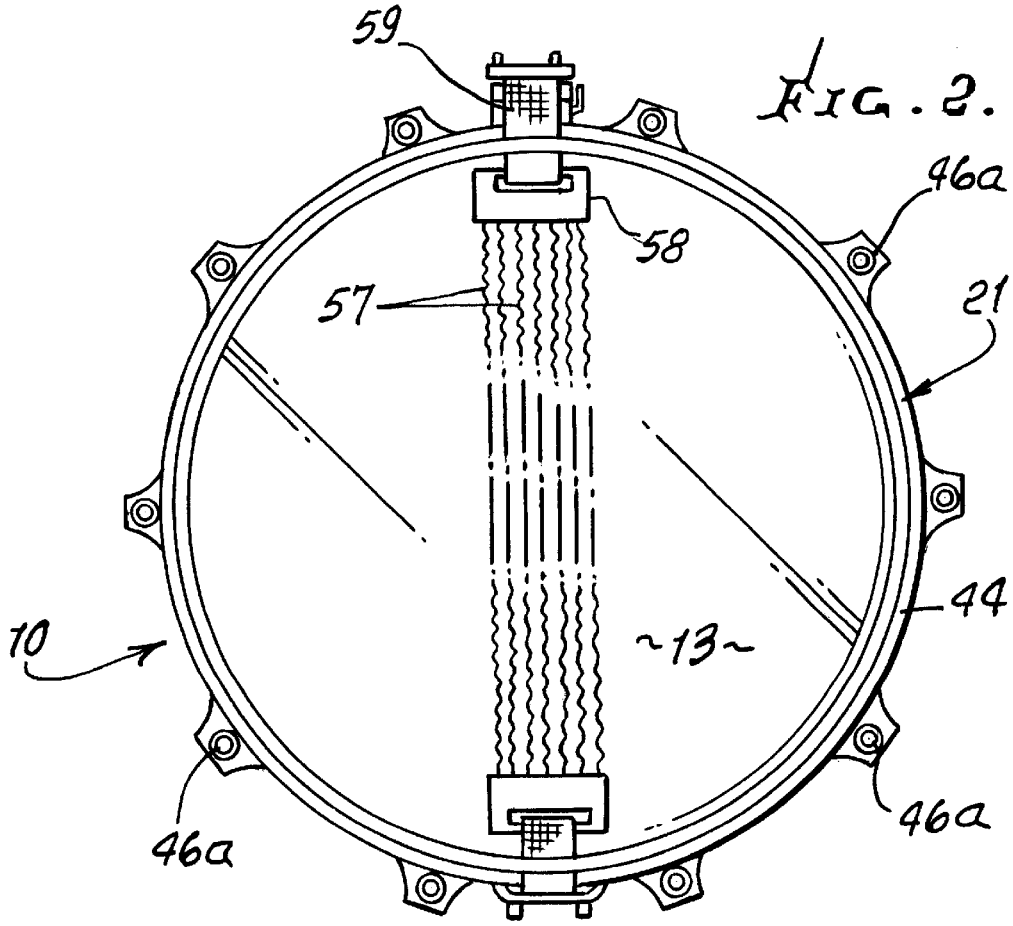
FIG. 2 is a plan view taken on lines 2—2 of FIG. 1.

In the drawings, a drum 10 has a shell 11 comprising a cylindrical section or sections located in axially extending position. Drum 10 may be a tom-tom.

Figure 3:
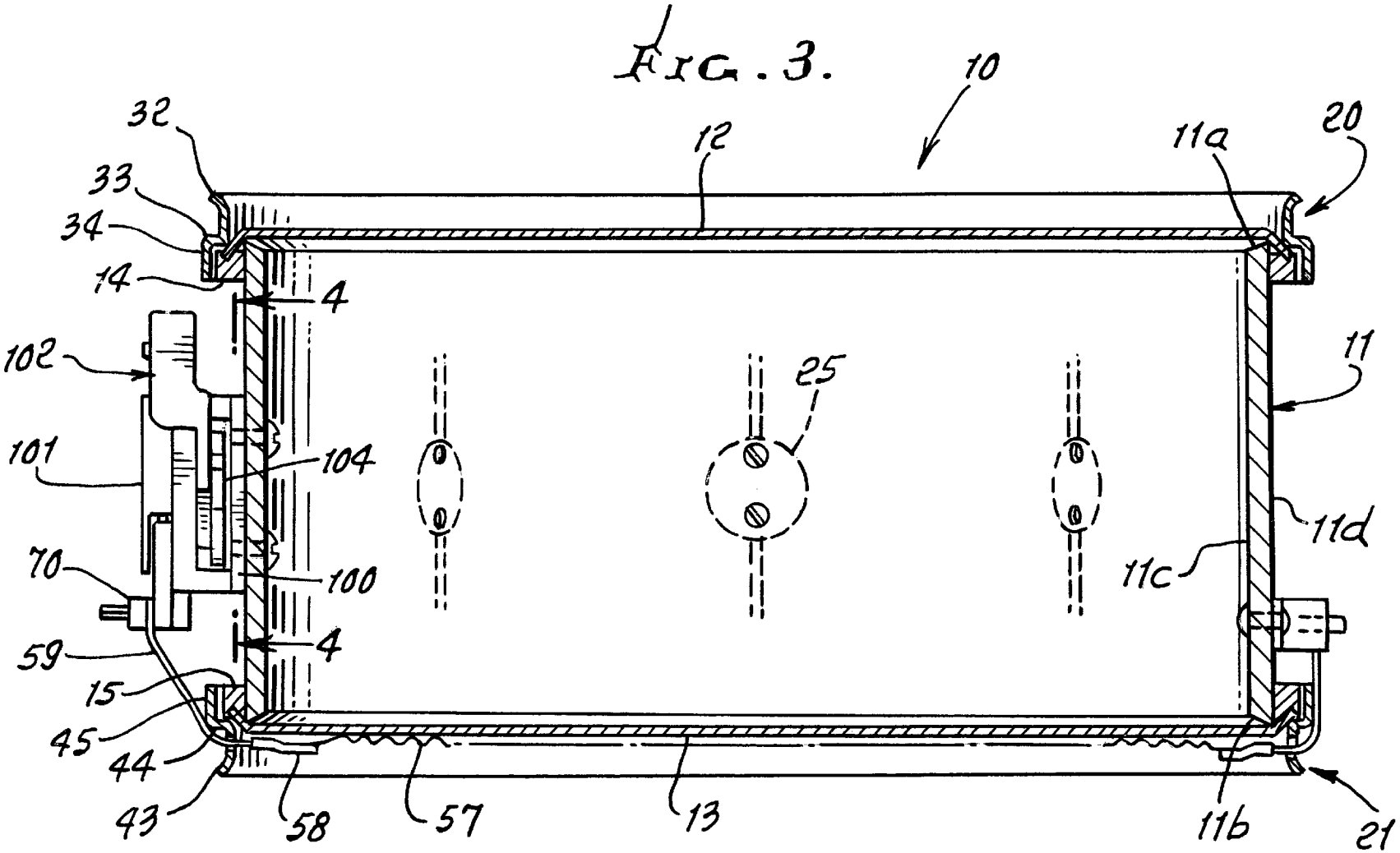
FIG. 3 is an enlarged vertical section taken on lines 3—3 of FIG. 1.
Figure 7:
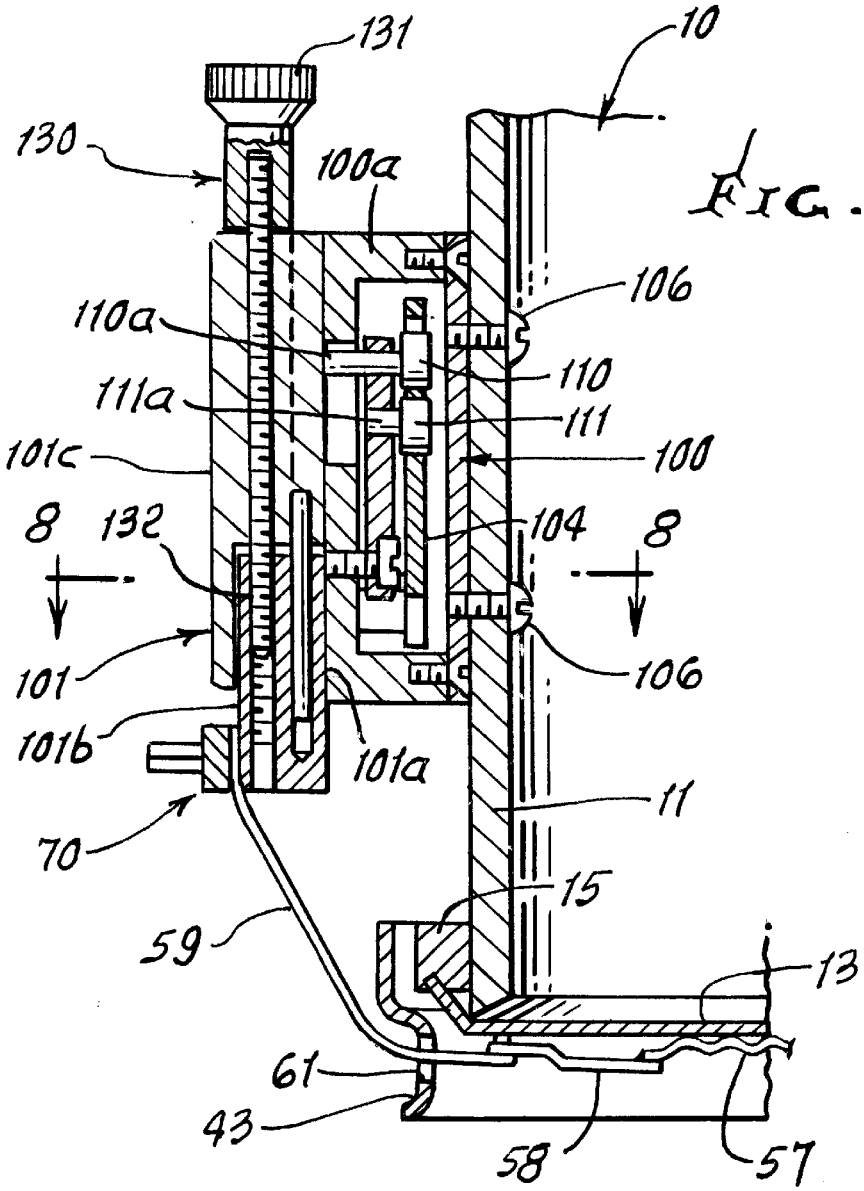
FIG. 7 is an elevation taken in section on lines 7—7 of FIG. 4.

Opposite annular and inwardly angled ends of the shell appear at 11*a* and 11*b* in FIG. 3. The shell typically consists of wood and has inner and outer cylindrical walls 11*c* and lid.

Drum heads 12 and 13 extend over the shell ends 11*a* and 11*b* and are retained in taut condition. They may consist of thin sheets of plastic or other material. Annular metallic flanges 14 and 15 are typically attached to the respective heads 12 and 13 for retaining them in taut condition. Flanges 14 and 15 extend about opposite end extents of the shell, as seen in FIG. 3.

The retainer structure shown includes flange structure 20 provided in association with one end 11*a* of the shell, and flange structure 21 in association with the other end 11*b* of the shell.

The upper flange structure 20 has an upwardly extending annular rim portion 32 extending above the level of drum head 12, a medial annular portion 33 extending radially outwardly below the level of 32, for transmitting head tightening loading to flange 14, and a lower annular extending portion 34 extending downwardly from the outer extent of 33. A tightening adjustment fastener rod 36 extends downwardly through 33 and has external threads that interfit upper internal threads in holder or stud 25. Note fastener head 36*a* bearing on the upper surface of 33 in FIG. 1. The lower surface of 33 exerts downward loading onto retention ring or flange 14 to which drum head 12 is attached, for adjusting its tautness, by drawing the head over 11*a*.

Likewise, lower flange structure 21 has a downwardly extending annular rim portion 43 extending below the level of drum head 13, a medial annular portion 44 extending radially outwardly above the level of 43 for transmitting head tightening loading, and an upper annularly extending portion 45 extending upwardly from outer extent of 44. A tightening adjusting fastener rod 46 extends upwardly through 44 and has external threads that interfit rotatably lower internal threads in holder or stud 25. Note fastener head 46*a* bearing on the lower surface of 44. The upper surface of 44 exerts upward loading onto lower retention ring or flange 15 to which drum head 13 is attached, for adjusting its tautness, i.e. over bevel 11*b*. Fasteners connect 25 to 11 at 47. Accordingly, the drum heads are individually adjustable, and acoustic benefits are enabled, while the drum heads are stretched over metal edges, with acoustic benefits.

Figure 9:
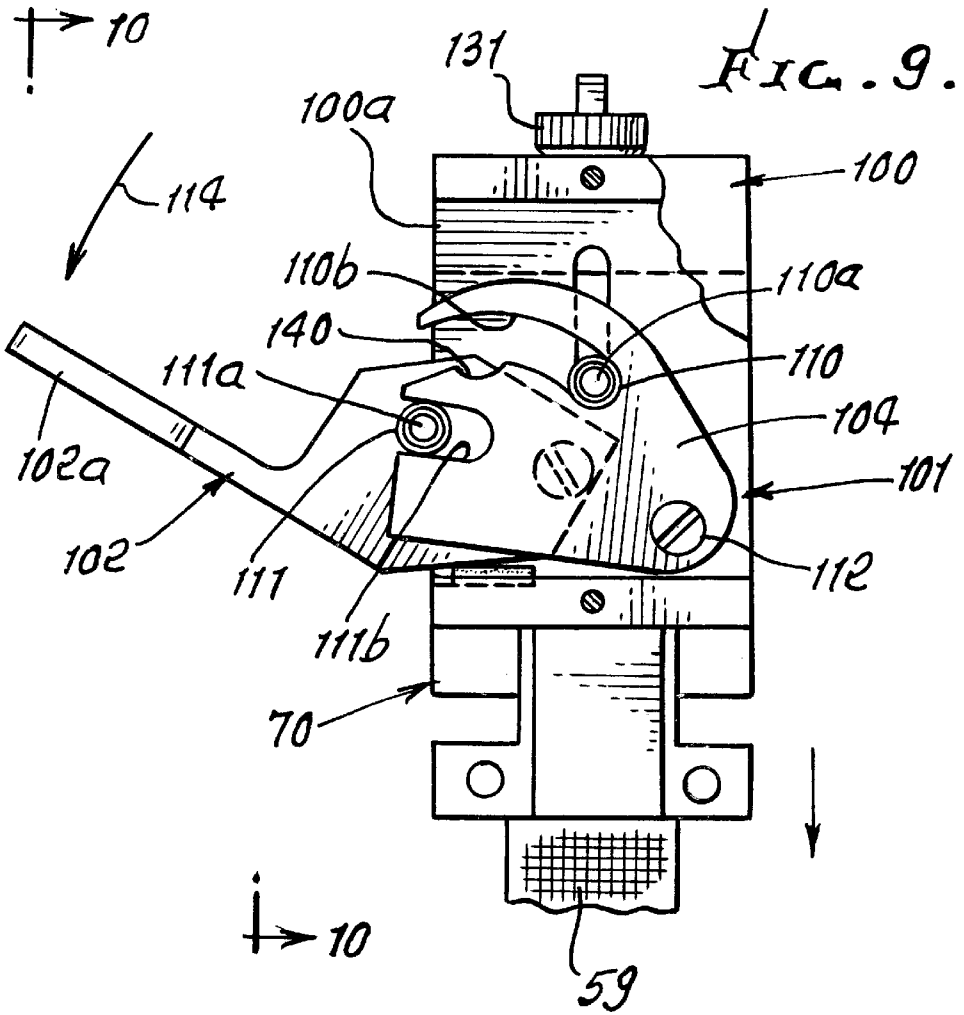
FIG. 9 is a view like FIG. 4 showing lever actuation.
Figure 10:
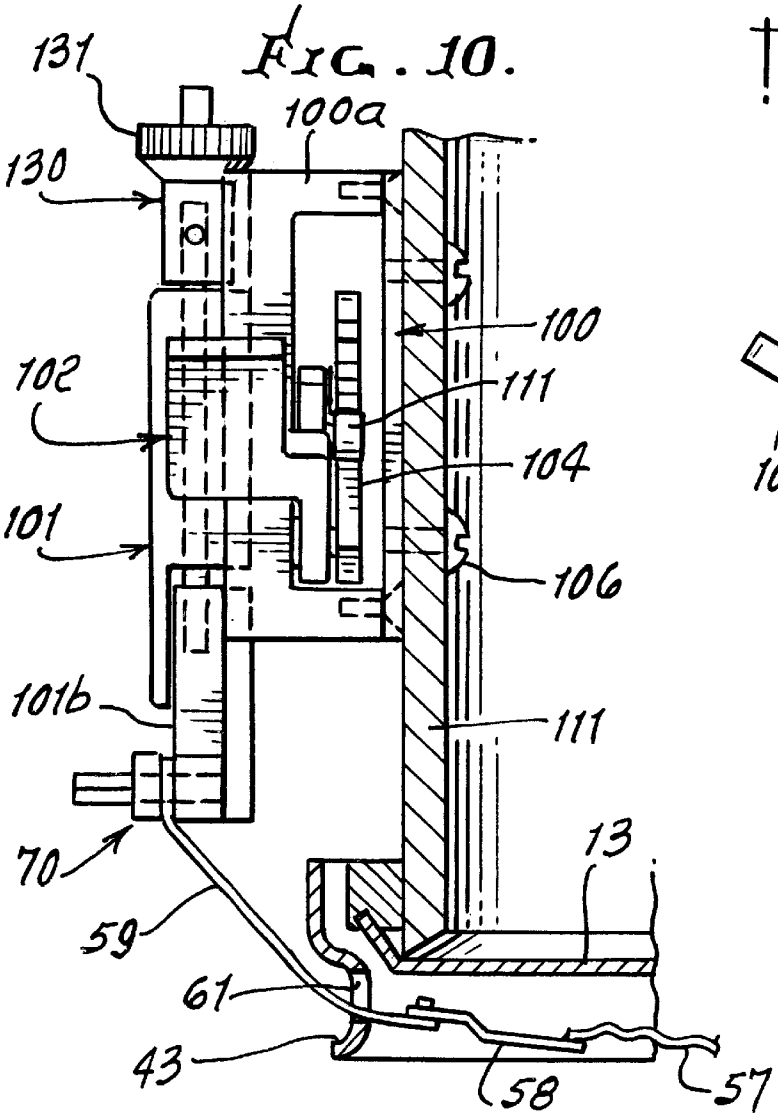
FIG. 10 is a frontal elevation taken on lines 10—10 of FIG. 9.

Referring to FIGS. 3–7, a strand tensioning throw-off device is shown, and includes:

a) a support body 100 shown as attachable to the side wall 11 of the drum;

b) a tensioning member 101 movable upwardly and downwardly relative to body 100 to tension or release the head striking strands 57 adjacent the drum head;

c) a lever 102 movable between selected positions, as for example are shown in FIGS. 4 and 9;

d) and anti-friction cam and follower roller elements that are relatively movable in response to such lever movement to effect the up and down movement of the tensioning member 101.

Typically, at least one of the described elements is or are carried by the lever; and the other or others of the element or elements is carried by the tensioning member, such as member 101. In the example, cam element 104 is carried by support body 100 in the form of a plate attached by fasteners 106 to the drum wall 11; and follower roller element or elements 110 and 111 are carried by axles 110*a* and 111*a* attached to the tensioning member 101, and to lever 102, respectively. Cam slots that receive the anti-friction rollers such as ball bearings are seen at 110*b* and 111*b*, in FIG. 9; and the cam is pivotally supported at 112 by body 100 to allow cam pivoting as between positions shown in FIGS. 4 and 9 as the lever itself is swung downwardly in direction 114 there being relative pivotal movement as between 102 and 104. Such downward swinging causes the roller elements 110 and 111 to move downwardly, and moves member 101 downwardly, as to FIG. 9 position, relieving the strands. The use of roller bearings quite substantially eases the lever and cam action, as well as contributes to overall compactness and guiding sturdiness of the assembly. A recess 140 in the side of slot 110*b* stabilizes seat roller 110 in FIG. 4 position. Also, the ends of the slots limit lever movement by engagement with the rollers, as shown.

Figure 8:
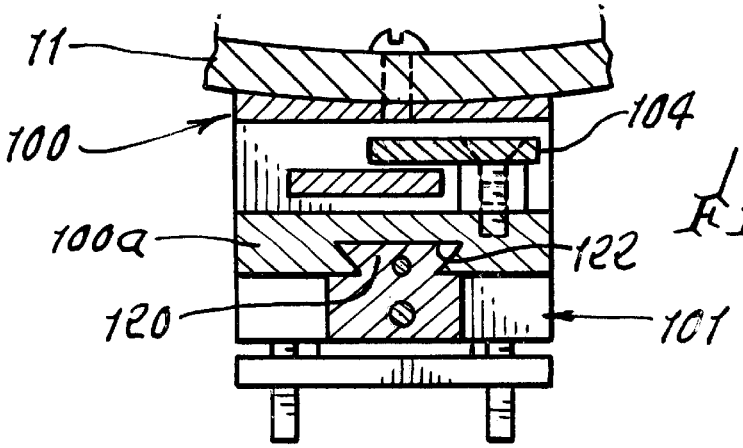
FIG. 8 is a horizontal section taken on lines 8—8 of FIG. 7.

Also shown, and of advantage, are a U-shaped portion 100*a* of the support body 100 housing the cam and roller bearings; and an elongated dove-tailed guide connection between portion 100*a* and the tensioning member 101. That guide includes a tongue 120 integral with the inner side 101*a* of member 101, and having vertical slide interfit in a trapezoidal shaped recess or groove 122 in portion 100*a* of body 100, as best seen in FIG. 8.

An adjuster 130 is provided to finely adjust strand tension. It has a rotatable handle 131 that projects above 100, and a screw thread connection at 132 to lower extent 101*b* of the tensioning member 101, to move 101*b* up or down relative to the upper extent 101*c* of member 101.

The ends of the strands 57 closest to the lever are connected at 58 to a strap 59 operatively connected to the member lower extent 101*b*. The latter is connected by releasable clamp 70 to the upper end of strap 59, the lower end of that strap extending through an opening 61 in the drum lower rim portion 43. As explained above, member 101 has operative connection with the lever to tension the strap and strands when the lever is swung upwardly, and to de-tension the strap and strands, when the lever is swung downwardly. Note lever handle 102*a*.

Figure 11:
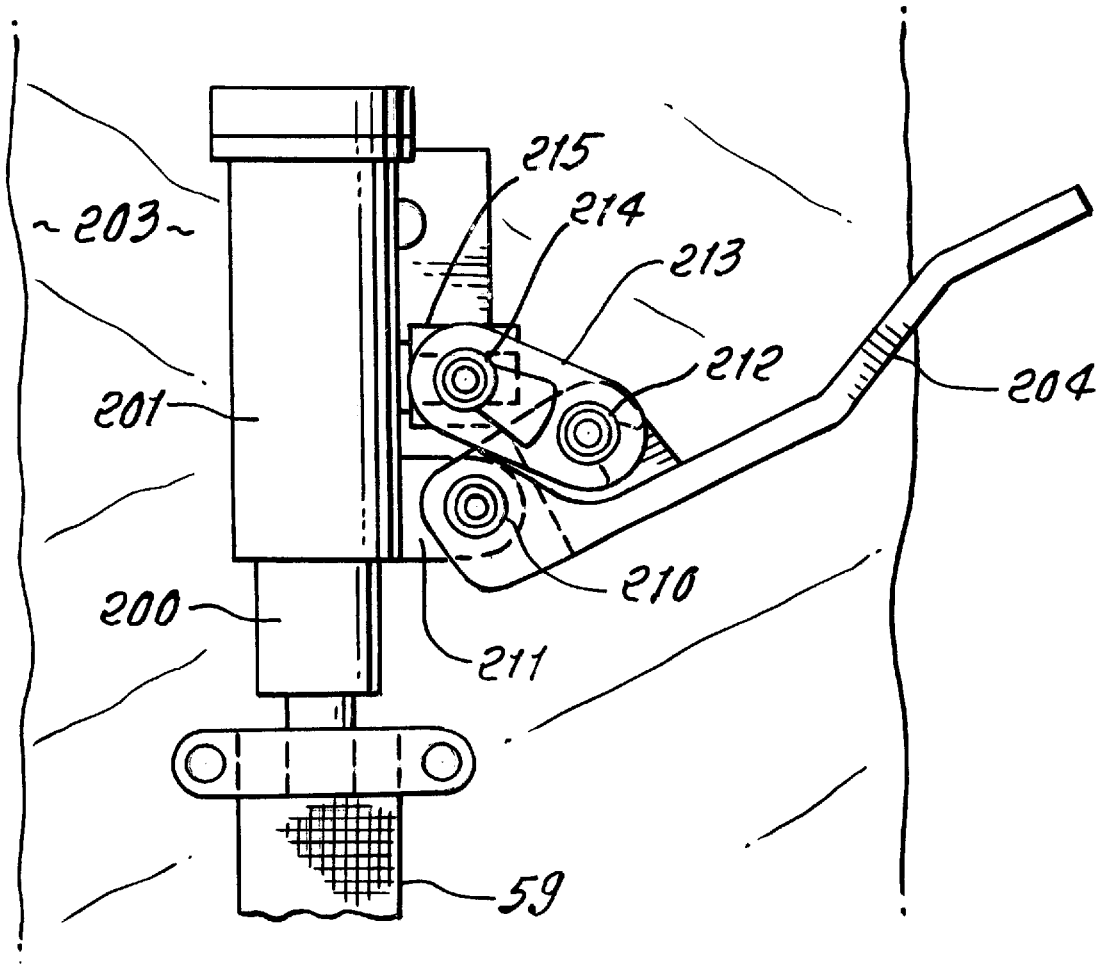
FIG. 11 is a frontal elevation showing a modification.

FIG. 11 shows a modification wherein a plunger 200 is movable up and down relative to a guide cylinder 201 attached to a drum wall 203. Plunger 200 is connected to a strap 59, which is in turn connected to strands as shown at 57 in FIG. 7.

A lever 204 has anti-friction roller bearing and link connection to the cylinder 201 and to the plunger, to move the plunger downwardly as the lever is swung in one direction, and vice versa. Note lever roller bearing connection at 210 to a tongue 211 attached to the plunger, and roller bearing connection at 212 to link 213, the latter having roller bearing connection at 214 to a tongue 215 attached to the cylinder.

I claim:

1. A throw-off device for use on a drum having a side wall and a head, comprising a) a support body attachable to the side wall of the drum, b) a tensioning member movable relative to said body to tension or release strands adjacent the drum head, c) a lever movable between selected positions, d) and cam and follower roller elements that are relatively movable in response to said lever movement to effect said member movement, e) said roller elements being captivated in guide slots in the cam, at least one of said elements including a roller bearing or bearings, f) there being two of said guide slots in the cam, one longer than the other and curved along its length, the cam pivotably connected to the support body.

2. The device of claim 1 wherein one of said elements is carried by said lever and another of said elements is carried by said tensioning member.

3. The device of claim 2 wherein said lever extends between said tensioning member and said cam.

4. The device of claim 3 wherein said cam is located between said lever and one part of said support body attachable to said side wall of the drum; the cam also being protected between the one part and a second part of the support body.

5. The device of claim 1 wherein said cam is located between said lever and one part of said support body attachable to said side wall of the drum; the cam also being protected between the one part and a second part of the support body.

6. The device of claim 1 wherein said cam is on a plate and said lever is swingable in a plane that is parallel to said cam plate.

7. The device of claim 4 wherein said cam is on a plate, and said lever is swingable in a plane that is parallel to said cam plate.

8. The device of claim 1 wherein the roller element or elements are captivated in a guide slot or slots in the cam.

9. The device of claim 1 including said strands, and a strap connecting the strands to said tensioning member, below said lever and said cam and follower elements.

10. In combination in drum apparatus:

a) cam and follower roller components which are relatively moveable, b) drum head striking strands operatively connected to one of said components to be tensioned and de-tensioned in response to such movement, c) and a lever having operative connection to a first of said components, to effect said movement thereof relative to the other component, d) two of said roller components captivated in two guide slots in the cam, one longer than the other and curved along its length, the cam pivotally connected to a support body, and at least one of said roller components including a roller bearing.

11. The device of claim 1 wherein said tensioning member has first and second sections which are relatively movable, one section connected to drum head striking strands, and adjustment means to control said relative movement of said sections to effectively tune the striking action of the strands, when tensioned by movement of the lever.

12. The combination of claim 8 wherein at least one slot has a side recess to seat a roller element and stabilize lever positioning.

* * * * *